US009812097B1

(12) United States Patent
Rich

(10) Patent No.: US 9,812,097 B1
(45) Date of Patent: Nov. 7, 2017

(54) PORTABLE ACCESSORY PEDAL AND SUPPORT FOR A MUSICAL INSTRUMENT

(71) Applicant: Ken Rich, Van Nuys, CA (US)

(72) Inventor: Ken Rich, Van Nuys, CA (US)

( * ) Notice: Subject to any disclaimer, the term of this patent is extended or adjusted under 35 U.S.C. 154(b) by 0 days.

(21) Appl. No.: 15/380,752

(22) Filed: Dec. 15, 2016

(51) Int. Cl.
*G10C 3/26* (2006.01)
*G10G 5/00* (2006.01)
*G10H 1/34* (2006.01)

(52) U.S. Cl.
CPC ..... *G10C 3/26* (2013.01); *G10G 5/005* (2013.01); *G10H 1/348* (2013.01)

(58) Field of Classification Search
CPC ..... G10C 3/26; G10G 5/005; G10H 1/348
USPC ..... 84/746
See application file for complete search history.

(56) References Cited

U.S. PATENT DOCUMENTS 1,740,017 A * 12/1929 Hunt ..... G10C 3/26 84/230
1,812,706 A * 6/1931 Mednikoff ..... G10C 3/26 84/231
2,030,929 A * 2/1936 Miyashita ..... G10C 3/26 84/232
2,463,910 A * 3/1949 Rydstrom ..... G10C 3/26 84/232
2,468,977 A * 5/1949 Hobbs ..... G10C 3/26 74/512
2,504,056 A * 4/1950 Townsend ..... G10C 3/26 74/562
2,625,070 A * 1/1953 French ..... G10H 1/348 84/426
3,763,735 A * 10/1973 Land ..... G10C 3/26 84/200
3,789,722 A * 2/1974 Hanes ..... G10C 3/14 84/426
4,018,128 A * 4/1977 Megee ..... G10C 3/26 84/231
4,041,829 A * 8/1977 Robeson ..... G10C 3/26 84/225
4,368,659 A * 1/1983 Kapreilian ..... G10C 3/26 84/228
4,561,339 A * 12/1985 Jensen ..... A47B 19/002 248/441.1
4,656,914 A * 4/1987 Weisser ..... G10C 3/26 84/232

(Continued)

FOREIGN PATENT DOCUMENTS

GB 193293 A * 2/1923 ..... G10C 3/26
GB 2326267 A * 12/1998 ..... A47C 9/08

*Primary Examiner* — David Warren
*Assistant Examiner* — Christina Schreiber
(74) *Attorney, Agent, or Firm* — File-EE-Patents.com; Jay A. Chesavage

(57) ABSTRACT

A foot pedal actuator is secured to legs of a portable musical instrument using a first elongate member having an aperture for a leg to pass through on one end, and an aperture for securing to a foot pedal actuator fastener aperture on the opposite end. A second elongate member has an aperture which is secured to the foot pedal actuator aperture on one end, and a rotatable attachment to the first elongate member along the span of the first elongate member. A third member similar to the first member and fourth member similar to the second member secure the four corners of the foot pedal actuator to two feet of the portable musical instrument, which pass through the leg apertures of the elongate members.

15 Claims, 1 Drawing Sheet

(56) References Cited

U.S. PATENT DOCUMENTS 5,458,039 A * 10/1995 Ashby ..... G10D 13/006 84/422.1
5,936,172 A * 8/1999 de La Rochefordiere ..... G10C 3/26 84/217
6,528,713 B2 * 3/2003 Maehara ..... G10C 3/26 84/225
6,528,714 B1 * 3/2003 Liao ..... G10D 13/065 84/422.1
7,049,500 B1 * 5/2006 Szczech ..... G10C 3/26 84/232
8,678,403 B1 * 3/2014 McCleave ..... B62B 3/02 248/129
2001/0037718 A1 * 11/2001 Maehara ..... G10C 3/26 84/426
2002/0112594 A1 * 8/2002 Maehara ..... G10C 3/26 84/426
2003/0188621 A1 * 10/2003 Sato ..... G10C 3/26 84/225
2004/0099133 A1 * 5/2004 Pu ..... G10C 3/26 84/746
2007/0007736 A1 * 1/2007 Kilday ..... B62B 5/0083 280/35
2009/0120264 A1 * 5/2009 Wheeler ..... G10C 1/04 84/174
2010/0176568 A1 * 7/2010 Kilday ..... B62B 3/12 280/79.11
2010/0326261 A1 * 12/2010 Stevens ..... G10D 13/08 84/746
2011/0214557 A1 * 9/2011 Arayama ..... G10H 1/32 84/746
2012/0255425 A1 * 10/2012 Oba ..... G10H 1/348 84/746
2015/0096425 A1 * 4/2015 Jones ..... G10C 3/26 84/229

* cited by examiner

Bottom View

Detail A–A

Detail A–A

Foot Pedal Attachment

Detail B–B

PORTABLE ACCESSORY PEDAL AND SUPPORT FOR A MUSICAL INSTRUMENT

FIELD OF THE INVENTION

The present invention relates to a portable mechanical support for a musical instrument. In particular, the invention relates to a structural system for a foot pedal actuator which maintains the position of the foot pedal with respect to the console of a portable musical instrument.

BACKGROUND OF THE INVENTION

Large stage concert musical instruments such as a grand piano or an upright piano are heavy and difficult to move, and so are typically used in fixed locations. These instruments may be positioned on rolling casters which allow the feet of the piano to be lifted above the floor with the heavy duty casters actuated below to move the piano, after which the actuation mechanism lowers the feet of the instrument and lifts the rolling casters with the piano legs again resting on the floor. While a concert piano may be moved for short distances in this manner, this proves to be unwieldy for most performance venues where the equipment is brought in and removed afterwards. To address this need, a class of portable pianos have been developed which provide the rich sound of a piano, either by electronic synthesis, or by miniaturizing the mechanisms of the full-size concert version while maintaining the pitch and timbre, or the portable piano may have a completely new sound.

A concert piano typically has foot pedals which are an integral part of the piano mechanism, and may also be part of the support structure for the piano. For a concert piano, these pedals, from left to right, are the "soft pedal" (una corda), which reduces the sound amplitude by having the action of the keys strike only one string of the triad usually associated with each key, the "sostunado pedal", which removes the damper from a struck key so the strings for that struck key continue to vibrate, and the "sustaining pedal" (or damper pedal), which raises the dampers from all of the strings so that all strings continue to vibrate after the struck keys are released.

Portable pianos use a foot operated actuator to perform these functions, and have a single operable pedal which typically performs the function of the sustain pedal, with the sustain pedal pushing an actuator rod upwards which raises the dampers from the strings or tines of the portable piano.

One examplar popular portable piano is the Rhodes piano, which comprises an elevated console part which contains the keyboard, hammers, wires or tines which vibrate in response to being struck by the hammer, electronic pickups for the tines, and a set of legs which elevate and support the console. The support legs are removable for quick setup, removal, and storage, and the sustain pedal function is performed by a foot pedal actuator which is placed on the floor. A recurring problem for musicians using portable pianos is the foot pedal actuator is not well supported, and may move during a musical performance, which effectively lengthens the actuator push rod and requiring greater pedal actuation distance, until the actuator pedal no longer provides enough displacement.

It is desired to provide an improved foot operated pedal actuator and support for use with a portable piano.

OBJECTS OF THE INVENTION

A first object of the invention is a foot pedal actuator support for mechanical connection to a foot pedal actuator, the foot pedal actuator support having four mechanical engagements arranged on the corners of the foot pedal actuator, the support capturing and engaging at least two legs supporting an elevated console, the support having:

a first elongate member positively engaged with a first corner of a foot pedal actuator on one end, and having an aperture for encircling a leg support on an opposite end;

a second elongate member positively engaged with an adjacent corner of a foot pedal actuator on one end, and having a rotatable attachment to a mid-span fastener of the first elongate member on an opposite end;

a third elongate member positively engaged with a third corner of a foot pedal actuator on one end, and having an aperture for encircling a support leg on an opposite end;

a fourth elongate member positively engaged with an adjacent corner of a foot pedal actuator on one end, and having a rotatable attachment to a mid-span fastener of the third elongate member on an opposite end.

A second object of the invention is a pedal actuator support comprising:

- a first elongate member having an aperture with a diameter sufficient to encircle a support leg on one end and an aperture for engagement to a foot pedal actuator on the opposite end;
- a second elongate member having an aperture for engagement to a foot pedal actuator on one end and a rotatable attachment to a mid-span fastener of the first elongate member on the opposite end.

SUMMARY OF THE INVENTION

In one example of the invention, a foot pedal actuator support comprises a first elongate member and a second elongate member, the first and second elongate members having apertures on one end for engagement to a foot pedal actuator. The opposite end of the first elongate member has an aperture for encircling a support leg of a musical instrument such as a portable piano console. The opposite end of the second elongate member is engaged with a rotatable attachment along the span of the first elongate member.

In another example of the invention, a first and second elongate member have respective ends with apertures and fasteners which are engaged to two corners of a foot pedal actuator on one end, and a third and fourth elongate member with respective ends having apertures and fasteners which are engaged to the opposite two corners of a foot pedal actuator, the opposite ends of the first and third elongate members having an aperture for encircling or capturing a support leg of a musical instrument, and where the opposite ends of the second and fourth elongate members have a rotatable attachment along the span of the first and third elongate members, respectively.

DETAILED DESCRIPTION OF THE INVENTION

Figure 1:
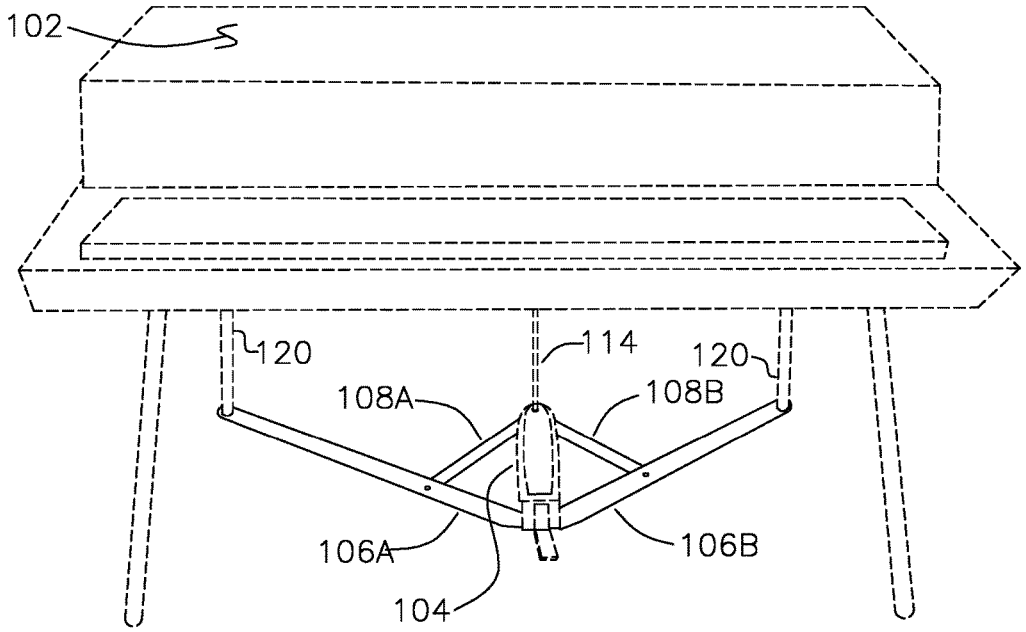
FIG. 1 shows a perspective view of a musical instrument and a pedal support.

FIG. 1 shows a portable musical instrument 102 such as a piano having support legs 120 and a sustain foot pedal actuator 104 having an a sustain actuator rod 114 for communicating foot pedal commands to the piano 102. Alternatively, the foot pedal 104 may be an electrical switch with an electrical cable or coupling 114 to the console 102. The foot pedal actuator 104 has corner mounting engagements such as threaded holes which receive fasteners such as screws which are threaded through apertures at the foot pedal actuator ends of respective left elongate support member 106A, left mid-span support member 108A, right elongate support member 106B, and right mid-span support member 108B.

Figure 2:
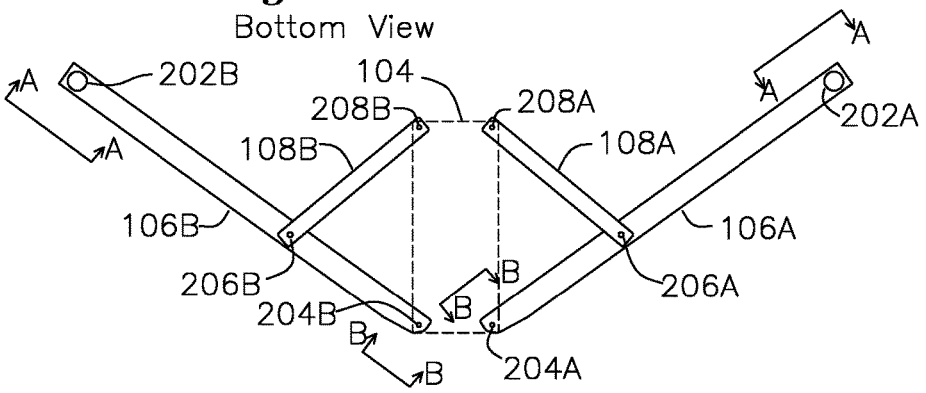
FIG. 2 shows a bottom view of FIG. 1 with a foot pedal actuator mechanically engaged with a left and right pedal support.

FIG. 2 shows a bottom view of the support (viewed from the floor upwards), and provides additional details for the support. The elongate members 106A and 106B have apertures 202A, 202B for encircling support legs 120, with the aperture 202A and 202B diameter being larger than the largest diameter of the leg 120 which passes through the aperture. Apertures 202A and 202B may be less than 3 inches in diameter, or preferably less than 2 inches in diameter to encircle support legs 120. In one example of the invention, the apertures 202A and 202B are approximately 1.125 inches in diameter. The mid-span supports 108A and 108B are fastened along the span of the right elongate member 106A and left elongate member 106B, respectively, where a rotatable attachment fastener 206A, and 206B, respectively provides a hinge point for the mid-span supports 108A and 108B, the rotatable attachment provided to accommodate different foot pedal actuator long axis length. The arrangement of the support system of FIGS. 1 and 2 provides a very sturdy mounting for the foot pedal actuator, which is constrained in position with respect to support leg position, and can no longer be displaced or knocked over during a performance.

In one example of the invention, elongate supports 106A, 106B are equal in length to each other and elongate supports 108A and 108B are of different but equal length to each other, thereby positioning the foot pedal actuator 104 below the midpoint of the centerline of the long axis of the console 102.

In another example of the invention, elongate supports 106A and 106B are different lengths to offset the foot pedal actuator 104 to one side or the other of the midpoint of the centerline of the long axis of the console 102, to comfortably position the foot pedal actuator for left or right foot operation.

Although the lengths of the elongate members need only be sufficient to satisfy the functional stability requirement for the foot pedal actuator, in another example of the invention, the range of lengths of the elongate members, measured from aperture center to aperture center are:

106A: 25-33 inches or substantially 27.5 inches

106B: 22-30 inches or substantially 24.5 inches with 108A and 108B having a length sufficient to maintain the long axis of foot pedal actuator 104 substantially perpendicular to the long axis of console 102. In examples of the invention, 108A and 108B are approximately 10.75 inches and 9.5, respectively, or either one may be in the range of 6 inches to 13 inches from aperture center to aperture center. Alternatively, 106A may be in the range 22-30 inches and 106B may be in the range 25-33 inches, or as required to position a foot pedal actuator in a desired location under a console 102 with respect to the position of the support legs which are encircled by elongate members 106A and 106B.

Figure 3A:
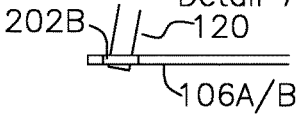
FIGS. 3A, 3B, and 3C show side views of the elongate supports and/or support leg or foot pedal actuator apertures of FIG. 1 and FIG. 2.
Figure 3B:
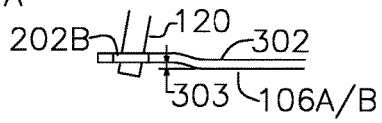
Figure 3C:
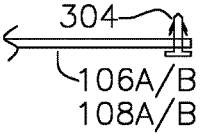

The elongate members 106A/106B may be attached to mid-span members 108A/108B using a screw and aircraft (locking) nut, or pressed-in fastener or stud, to provide rotatable attachment 206A/206B. Foot pedal actuator 104 may be attached to the elongate members at respective elongate member engagement apertures 204A, 204B, 208A, and 208B using a screw, or captured button fastener 304 with engagement barbs or engagement surfaces for insertion into the foot pedal 104 as shown in FIG. 3C so that foot pedal actuator 104 may be quickly attached and removed, elongate members 106A/108A and 106B/108B folded into a linear arrangement, and conveniently stored into a space saving cardboard tube. Alternatively, to provide an adjustable support assembly for use with a variety of different pianos with different support leg separation distances, the elongate members 106A/106B may have a central slot or a plurality of fastener apertures which are oriented along the long axis of the elongate members 106A/106B such that rotatable attachment 206A/206B may be moved along the central slot or to one of the plurality of apertures to lengthen or shorten the aperture separation distance from 202A to 202B, thereby accommodating a wide variety of support leg separation distances for various pianos. In another alternative embodiment, the support assembly of FIG. 1 is rotated approximately 180 degrees, with the support leg attachments using the front legs 120 of the piano 102 and the foot pedal actuator rotated approximately 180 degrees in attachment so that it is oriented as shown in FIG. 1. In another alternative embodiment, the support assembly of FIG. 1 is engaged to the two left side support legs of piano 102, or to the two right side support legs of piano 102, with the elongate members 106B and 108B attached to the front two fasteners of foot pedal actuator 104, and the elongate members 106A and 108A attached to the rear two fasteners of foot pedal actuator 104. The terms approximately, when applied to angular or linear dimensions, are understood to mean 30% greater or 30% smaller than the stated dimension.

The elongate member 106A and 106B may require additional fastening security with respect to the legs 120 of the musical instrument 102. FIG. 3A shows the side view of the elongate beam 106B with relation to support leg 120, showing a first example of member 106B which is straight. FIG. 3B shows the side view of elongate beam 106B with relation to support leg 120 in a second example where an offset bend 302 is present to offset the support aperture 202A/B from the support surface (such as a floor) on which leg 120 rests. The offset bend 302 may be located 1 to 12 inches from an end of the elongate member, preferably 1-3 inches from the edge of the leg aperture, with the offset 303 preferably at least 0.25 inches, measured with respect to a surface of the elongate member.

I claim:

1. A support for a foot pedal actuator having three engagement apertures, the support operative to rest on a horizontal surface and secure a foot pedal resting on the same horizontal surface in a non-rotatable position, the support comprising:

a first elongate member having an engagement aperture for engagement with a foot pedal actuator on one end, the first elongate member having an engagement aperture for encircling a support leg substantially perpendicular to the horizontal surface on the opposite end;

a second elongate member having an engagement aperture for engagement with a foot pedal actuator on one end and having a rotatable attachment to a point along the span of the first elongate member on the opposite end;

the foot pedal actuator resting on the horizontal surface and coupled exclusively to the first elongate member and the second elongate member.

2. The support of claim 1 where said rotatable attachment is a screw or stud passing through the first elongate member and second elongate member, and secured with a nut.

3. The support of claim 1 where said first elongate member foot pedal actuator engagement aperture and said second elongate member engagement aperture has provision for mounting a foot pedal actuator with at least two mounting apertures at the corner vertices of the foot pedal actuator.

4. The support of claim 1 where said foot pedal actuator includes an engagement aperture which is either a screw fastener aperture or a captured button fastener aperture having an engagement surface or barbs for insertion into a foot pedal actuator.

5. The support of claim 1 where said support leg aperture diameter is substantially 1.25 inches.

6. The support of claim 1 where said first elongate member is in the range of 22-30 inches or 35-30 inches when measured from the center of said support leg engagement aperture to the center of said foot pedal engagement aperture.

7. A support for a foot pedal actuator having four engagements, the foot pedal resting on a horizontal surface, the support comprising:

a first elongate member resting on the horizontal surface and having a support leg aperture on one end and a foot pedal actuator engagement aperture on the opposite end;

a second elongate member having a foot pedal actuator engagement aperture on one end and a rotatable attachment to the first elongate member on the opposite end;

a third elongate member resting on the horizontal surface and having a support leg aperture on one end and a foot pedal actuator engagement aperture on the opposite end;

a fourth elongate member having a foot pedal actuator engagement aperture on one end and a rotatable attachment to the third elongate member on the opposite end.

8. The support of claim 7 where at least one of said first support or said third support leg aperture diameter is substantially 1.25 inches.

9. The support of claim 7 where said first member or said third member rotatable engagement comprises a screw or stud passing through an aperture of said second or said fourth member mid-span aperture and secured with a nut.

10. The support of claim 7 where said first member or said third member is substantially planar over its extent.

11. The support of claim 7 where said first member or said third member has an offset of at least 0.25 inch within 1 to 12 inches of the leg aperture end.

12. The support of claim 7 where said first elongate member is in the range of 22-30 inches or 35-30 inches when measured from the center of said leg pedal aperture to the center of said foot pedal actuator aperture.

13. A support for a musical instrument, comprising:

A first elongate member positioned on a horizontal surface and having an aperture perpendicular to the horizontal surface for encircling a support leg on one end and a foot pedal actuator mounting aperture on the opposite end;

a second elongate member positioned on the horizontal surface and having an foot pedal actuator mounting aperture on one end and a rotatable attachment to the first elongate member on the opposite end;

whereby a first vertical support leg and a second vertical support leg positioned through the support leg apertures affix the a pedal actuator also resting on the horizontal surface in a non-rotatable position with respect to the vertical support legs.

14. The support of claim 13 where said elongate member has an offset bend within 1 to 12 inches of the end of said elongate member.

15. A foot pedal actuator support assembly, the foot pedal actuator having a planar bottom surface with four engagements, the support assembly comprising:

a foot pedal actuator having four engagement apertures substantially arranged on corners of the foot pedal actuator, the engagement apertures having a center axis which is substantially perpendicular to the bottom surface;

a first elongate member positioned substantially co-planar to the foot pedal actuator bottom surface, the first elongate member having a support leg aperture on one end and a foot pedal actuator engagement aperture on the opposite end;

a second elongate member positioned substantially co-planar to the foot pedal actuator bottom surface, the second elongate member having a foot pedal actuator engagement aperture on one end and a rotatable attachment to the first elongate member span on the opposite end;

a third elongate member positioned substantially co-planar to the foot pedal actuator bottom surface, the third elongate member having a support leg aperture on one end and a foot pedal actuator engagement aperture on the opposite end;

a fourth elongate member positioned substantially co-planar to the foot pedal actuator bottom surface, the fourth elongate member having a foot pedal actuator engagement aperture on one end and a rotatable attachment to a span of the third elongate member on the opposite end;

said first elongate member pedal engagement aperture secured to one of said foot pedal actuator apertures;

said second elongate member pedal engagement aperture secured to one of said foot pedal actuator apertures;

said third elongate member pedal engagement aperture secured to one of said foot pedal actuator apertures;

said fourth elongate member pedal engagement aperture secured to one of said foot pedal actuator apertures.

* * * * *